US006669522B2

(12) United States Patent
Nishida

(10) Patent No.: US 6,669,522 B2
(45) Date of Patent: Dec. 30, 2003

(54) HIGH PRESSURE DISCHARGE LAMP AND METHOD FOR PRODUCING THEREOF

(75) Inventor: Kazuhisa Nishida, Tokyo (JP)

(73) Assignee: NEC Microwave Tube, Ltd., Sagamihara (JP)

( * ) Notice: Subject to any disclaimer, the term of this patent is extended or adjusted under 35 U.S.C. 154(b) by 0 days.

(21) Appl. No.: 10/396,560

(22) Filed: Mar. 26, 2003

(65) Prior Publication Data

US 2003/0184230 A1 Oct. 2, 2003

Related U.S. Application Data

(62) Division of application No. 09/801,662, filed on Mar. 9, 2001, now Pat. No. 6,570,329.

(30) Foreign Application Priority Data

Mar. 10, 2000 (JP) ..... P2000-067608

(51) Int. Cl.[7] ..... H01J 17/20; H01J 61/20; H01J 9/00; H01J 9/38

(52) U.S. Cl. ..... 445/26; 445/40; 313/639; 313/570

(58) Field of Search ..... 313/639, 637, 313/570, 571; 445/26, 40

(56) References Cited

U.S. PATENT DOCUMENTS 5,109,181 A 4/1992 Fischer et al.
5,461,281 A 10/1995 Fromm et al.
5,691,601 A * 11/1997 Frey et al. ..... 313/571
5,810,635 A 9/1998 Heider et al.
6,211,616 B1 * 4/2001 Takeuti et al. ..... 313/637
6,271,628 B1 8/2001 Sugitani et al.

FOREIGN PATENT DOCUMENTS

| | | |
|---|---|---|
| JP | 2-148561 | 6/1990 |
| JP | 3-219548 | 9/1991 |
| JP | 6-290748 | 10/1994 |
| JP | 6-349410 | 12/1994 |
| JP | 7-57697 | 3/1995 |
| JP | 8-287867 | 11/1996 |
| JP | 9-86959 | 3/1997 |
| JP | 2829339 | 9/1998 |
| JP | 11-149899 | 6/1999 |
| JP | 11-297268 | 10/1999 |
| JP | 11-297274 | 10/1999 |

* cited by examiner

*Primary Examiner*—Kenneth J. Ramsey
*Assistant Examiner*—Peter Macchiarolo
(74) *Attorney, Agent, or Firm*—McGinn & Gibb, PLLC

(57) ABSTRACT

A high pressure discharge lamp includes a quartz glass bulb having a sealing portion; and a pair of electrodes. Each electrode of the pair of electrodes is disposed so as to be opposite the other in the quartz glass bulb. The quartz glass bulb of the high pressure discharge lamp contains at least mercury and a halogen gas. The partial pressure of oxygen (O) in the quartz glass bulb is about $2.5\times10^{-3}$ Pa or less and the partial pressure of the halogen gas in the quartz glass bulb is in the range between about $1\times10^{-8}$ $\mu$mol/mm$^3$ and $1\times10^{-7}$ $\mu$mol/mm$^3$.

13 Claims, 3 Drawing Sheets

HIGH PRESSURE DISCHARGE LAMP AND METHOD FOR PRODUCING THEREOF

The present Application is a Divisional Application of U.S. patent application Ser. No. 09/801,662, filed on Mar. 9, 2001 now U.S. Pat. No. 6,570,329.

BACKGROUND OF THE INVENTION

1. Field of the Invention

The present invention relates to a high pressure discharge lamp and a method for producing the high pressure discharge lamp. More specifically, the present invention relates to a long-life high pressure discharge lamp which, even after being used for a long time, has a low degree of blackening or decrease in luminance and is capable of preventing leakage of a contained gas or a blowout of a bulb, and a method for manufacturing such a high pressure discharge lamp.

2. Description of Related Art

In general, a high pressure discharge lamp has a structure, for instance, as shown in FIG. 4. In the high pressure discharge lamp 110 shown in FIG. 4, each electrode of a pair of electrodes 102 and 102 made of tungsten is disposed so as to be opposite the other in a quartz glass bulb 101, which includes a round-shaped central portion. Each of these electrodes 102 and 102 is inserted from a respective insertion opening 104 located at an end of the bulb 101 and each of the insertion openings 104 is airtightly sealed with the respective electrode 102 via a sleeve-shaped molybdenum foil 105 which is a thermal cushioning material. A halogen gas, such as mercury gas or methylene bromide gas, and an inert gas, such as argon, are contained and sealed in the bulb 101.

In general, a relatively large amount of mercury, for instance, in an amount of more than 0.15 mg/mm$^3$, is contained in the high pressure discharge lamp 110. When the lamp 110 is lit and a trigger voltage is applied to the electrodes 102 and 102, a glow discharge is induced between the electrodes under the atmosphere of the above-mentioned inert gas and the contained mercury is vaporized to emit light of high luminance and excellent color rendering property due to a plasma discharge by the high-pressure mercury vapor. Since light of high luminance and excellent color rendering property is obtained by using the high pressure discharge lamp as explained above, the lamp has recently attracted attention as a light source for devices such as a projection type liquid crystal display and used for a variety of purposes.

During the initial phase of using the high pressure discharge lamp, problems associated with the use thereof were pointed out that blackening of the inner surface of a bulb is caused and the luminance of the lamp is lowered after being lit for a considerably long time. These problems are attributed to the fact that, as shown in FIG. 4, tungsten atoms or molecules W are vaporized by the discharge which occurs at high temperatures and deposited onto the inner surfaces of the bulb 101. Accordingly, in order to prevent the generation of blackening, a halogen gas is used and sealed in the bulb 101. The halogen gas produces halogen ions at high temperatures which bond to and vaporize the tungsten deposited onto the inner surface of the bulb 101 and re-deposit the tungsten onto a base portion of the electrode at which temperature is relatively low. This is a so-called "halogen cycle" and this cycle is repeated so that the generation of blackening of the bulb may be prevented.

A halogen compound, such as methylene bromide, is generally used as the above-mentioned halogen gas. The halogen compound, when the lamp is lit, is decomposed in the bulb 101 and generates halogen ions. In general, the halogen gas is contained so that the partial pressure of the halogen gas in the bulb 101 becomes $1\times10^{-6}$ $\mu$mol/mm$^3$ or greater which is considered to be an amount effective for preventing the generation of blackening.

Also, an inert gas, such as argon, is contained in the bulb 101 in an amount in the range between about $6\times10^3$ Pa and $6\times10^4$ Pa in order to induce a glow discharge at the start of lighting the lamp 110.

However, although a halogen gas is contained in the bulb 101 in order to prevent a decrease in the luminance of the lamp 110 due to the generation of blackening as mentioned above, the halogen gas, when present excessively, tends to erode and deteriorate the electrodes 102 and molybdenum, foils 105 at the sealing portions of the bulb 101. If the erosion proceeds, a contained gas may leak from the sealing portions or a blowout of the bulb 101 may be caused since the pressure inside the bulb 101 exceeds 100 atmosphere due to the vapor pressure of the contained mercury. For this reason, studies have been conducted to achieve a total improvement of the high pressure discharge lamp, the improvement including the structure thereof and an amount of various components contained in the bulb 101 in order to prevent problems such as the generation of blackening, leaking of contained gases and a blowout of the bulb 101.

For example, the Japanese Unexamined Patent Application, First Publication No. 11-149899 discloses an amount of mercury contained between 0.12 and 0.35 mg/mm$^3$, an amount of a halogen gas between $7^{-7}$ and $10^{-2}$ $\mu$mol/mm$^3$, and an amount of potassium oxide contained in an electrode of 12 ppm or less.

The Japanese Patent No. 2829339 discloses an amount of mercury contained between 0.2 and 0.35 mg/mm$^3$, and an amount of a halogen gas between $10^{-6}$ and $10^{-4}$ $\mu$mol/mm$^3$.

The Japanese Patent No. 2980882 discloses an amount of mercury of 0.16 mg/mm$^3$ or more, an amount of a halogen gas between $2\times10^{-4}$ and $7\times10^{-3}$ $\mu$mol/mm$^3$, and preferably a bulb wall loading of 0.8 W/mm$^2$ or more and an amount of an inert gas of $5\times10^3$ or more.

The Japanese Unexamined Patent Application, First Publication No. 11-297274 discloses an amount of mercury which becomes between 100 and 200 atmospheres when a lamp is lit, and an amount of a halogen gas between $1.1\times10^{-5}$ and $1.2\times10^{-7}$ mol/cc.

However, no matter how the amount of components contained in the bulb of the high pressure discharge lamp is adjusted as described in the above-mentioned documents, problems of the decrease in the luminance of a lamp due to the generation of blackening, leakage of contained gas, and blowout of the bulb cannot be solved by any single means at the same time.

Accordingly, an object of the present invention is to provide a high pressure discharge lamp in which the above-mentioned problems have been solved and a method for producing such a high pressure discharge lamp.

Another object of the present invention is to provide a long-life high pressure discharge lamp which, even after being used for a long time, has a low degree of blackening or decrease in luminance and is capable of preventing leakage of the contained gas or a blowout of the bulb, and a method for manufacturing such a high pressure discharge lamp.

The inventors of the present invention, after pursuing diligent studies to achieve the above-mentioned objectives, discovered that although an air in a bulb is vacuumed by using such means as a vacuum pump in advance of the introduction of various components to be contained in a conventional high pressure discharge lamp, oxygen components such as oxygen gas or carbon dioxide still remain in the bulb to some extent and these oxygen components inhibit the above-mentioned halogen cycle when the lamp is lit. It was observed that an excessive amount of a halogen gas must be contained in the bulbs of the conventional high pressure discharge lamps for the reason mentioned above and this shortens the life of the high pressure discharge lamps.

The inventors of the present invention also discovered that the above-mentioned problems may be solved by a high pressure discharge lamp including a quartz glass bulb in which each electrode of a pair of electrodes is disposed so as to be opposite the other in an airtightly sealed quartz glass bulb containing at least mercury and a halogen gas, wherein the partial pressure of oxygen (O) in the quartz glass bulb is about $2.5\times10^{-3}$ Pa or less and the partial pressure of the halogen gas in the quartz glass bulb is in the range between about $1\times10^{-8}$ $\mu$mol/mm$^3$ and $1\times10^{-7}$ $\mu$mol/mm$^3$.

In the high pressure discharge lamp according to an embodiment of the present invention mentioned above, the inhibition of the halogen cycle by the remaining oxygen is minimized since the partial pressure of oxygen in the lamp is restricted to about $2.5\times10^{-3}$ Pa or less. Therefore, according to the present invention, the amount of a halogen gas contained in the bulb may be reduced as compared to that in a conventional bulb and this leads to a prevention of leakage of the contained gas or a blowout of the bulb due to the introduction of an excessive amount of halogen gas. Also, the generation of blackening of the bulb may be prevented even after being lit for a considerably long time, and it becomes possible to obtain a long-life high pressure discharge lamp.

In a conventional process for producing a discharge lamp, on the other hand, although air in a bulb is tentatively evacuated to some extent in advance of the introduction of a halogen gas or an inert gas, the vacuum is not carried out to a degree by which the level of the oxygen partial pressure becomes $2.5\times10^{-3}$ Pa or less since it was not known until recently that the presence of oxygen inhibits the halogen cycle.

In addition, it was discovered that the remaining oxygen in the bulb decreases the production efficiency of mercury plasma and also decreases an initial luminance of the discharge lamp. Accordingly, the initial luminance of the discharge lamp can be improved and the time required for lighting the lamp (or the induction period of the lamp) may be shortened by restricting the partial pressure of oxygen to about $2.5\times10^{-3}$ Pa or less. In this manner, a high pressure discharge lamp which is capable of quickly reaching its stable state of luminance and maintaining the luminance for a considerably long time may be obtained by an embodiment of the method according to the present invention.

In this specification, the term "partial pressure of oxygen (O)" means a total of partial pressure of oxygen-containing gases, such as $O_2$, CO, $CO_2$, and $H_2O$. The partial pressure of oxygen may be measured by taking a sample of the gas contained in a manufactured high pressure discharge lamp, and analyzing the sample using any suitable means.

SUMMARY OF THE INVENTION

The present invention provides a high pressure discharge lamp, including: a quartz glass bulb having a sealing portion; and a pair of electrodes, each electrode of the pair of electrodes being disposed so as to be opposite the other in the quartz glass bulb; wherein at least mercury and a halogen gas are contained and sealed in the quartz glass bulb, and the partial pressure of oxygen (O) in the quartz glass bulb is about $2.5\times10^{-3}$ Pa or less and the partial pressure of the halogen gas in the quartz glass bulb is in the range between about $1\times10^{-8}$ $\mu$mol/mm$^3$ and $1\times10^{-7}$ $\mu$mol/mm$^3$.

In accordance with another aspect of the invention, the amount of mercury contained in the quartz glass bulb is about 0.15 mg/mm$^3$ or greater with respect to the volume of the quartz glass bulb.

According to the above high pressure discharge lamp, the amount of mercury contained in the quartz glass bulb is about 0.15 mg/mm$^3$ or greater with respect to the volume of the quartz glass bulb and the partial pressure of the halogen gas in the quartz glass bulb is in the range between about $1\times10^{-8}$ $\mu$mol/mm$^3$ and $1\times10^{-7}$ $\mu$mol/mm$^3$. On the other hand, although the amount of amount of mercury contained in a bulb of a conventional high pressure is about 0.15 mg/mm$^3$ or greater, the partial pressure of a halogen gas contained in the bulb is $1\times10^{-6}$ $\mu$mol/mm$^3$ or greater in order to prevent a blackening of bulb wall due to the halogen cycle. Therefore, the above-mentioned high pressure discharge lamp according to the present invention is capable of avoiding the deterioration of electrodes or conductive elements in the vicinity of the sealing portions due to excessive halogen gas. Hence, leakage of contained gas or blowout of the bulb may be prevented and the lifetime of the high pressure discharge lamp may be extended. The halogen cycle does not proceed smoothly if the partial pressure of the halogen is less than $1\times10^{-8}$ $\mu$mol/mm$^3$.

In yet another aspect of the invention, the halogen gas contains bromine, chlorine, or iodine. This is because the halogen gas containing bromine, chlorine, or iodine can realize a smooth halogen cycle.

In yet another aspect of the invention, the high pressure discharge lamp further includes an inert gas which is contained and sealed in the quartz glass bulb, and the amount of the inert gas in the quartz glass bulb is in the range between about $6\times10^3$ Pa and $6\times10^4$ Pa.

The inert gas used in the above high pressure discharge lamp may be helium, argon, neon, or nitrogen. These inert gases are useful as a glow-starter.

In yet another aspect of the invention, the quartz glass bulb has insertion openings through which the pair of electrodes are inserted into the quartz glass bulb. It is preferable that the insertion openings are airtightly sealed with the pair of electrodes via a conductive element so as to form the sealing portions.

In yet another aspect of the invention, the conductive element is molybdenum foil.

According to the above high pressure discharge lamp, since an evacuation process of the quartz glass bulb or an introduction of gases to the bulb may be carried out by using at least one of the insertion openings through which the one of the electrodes is inserted, it is not necessary to form another opening for carrying out the evacuation process or the introduction process. On the other hand, the conductive element or molybdenum foil of sleeve-shape is present between the insertion opening of the quartz glass bulb and the electrode so as to airtightly seal the insertion opening with the electrode and to generate a thermal cushioning effect for the heat cycle of the high pressure discharge lamp.

In yet another aspect of the invention, the bulb wall loading of the quartz glass bulb is in the range between about 0.8 W/mm$^2$ and 2.0 W/mm$^2$.

If the bulb wall loading of the quartz glass bulb is outside of the above-mentioned range, the luminous efficacy (lumen/W) of the lamp will be reduced.

The present invention also provides a method for manufacturing a high pressure discharge lamp including a quartz glass bulb having a sealing portion; a pair of electrodes, each electrode of the pair of electrodes being disposed so as to be opposite the other in the quartz glass bulb; and at least mercury and a halogen gas contained and sealed in the quartz glass bulb, including the steps of: carrying out an evacuation process in which the quartz glass bulb is evacuated so that the partial pressure of oxygen (O) in the quartz glass bulb becomes about $2.5\times10^{-3}$ Pa or less; and carrying out an introduction process in which the halogen gas is introduced into the quartz glass bulb so that the partial pressure of the halogen gas in the quartz glass bulb falls in the range between about $1\times10^{-8}$ $\mu$mol/mm$^3$ and $1\times10^{-7}$ $\mu$mol/mm$^3$.

According to the above method, since the partial pressure of oxygen (O) in the quartz glass bulb becomes about $2.5\times10^{-3}$ Pa or less, and the partial pressure of the halogen gas in the quartz glass bulb is in the range between about $1\times10^{-8}$ $\mu$mol/mm$^3$ and $1\times10^{-7}$ $\mu$mol/mm$^3$, it becomes possible to produce a long-life high pressure discharge lamp.

In yet another aspect of the invention, the method for manufacturing a high pressure discharge lamp further including the steps of: carrying out a first electrode assembling process in which one of the pair of electrodes is inserted into a first insertion opening formed in the quartz glass bulb and then the first insertion opening is airtightly sealed; and carrying out a second electrode assembling process in which the other one of the pair of electrodes is inserted into a second insertion opening formed in the quartz glass bulb and then the second insertion opening is airtightly sealed, wherein oxygen present in the quartz glass bulb is evacuated from the second insertion opening in the evacuation process after the first electrode assembling process and before the second electrode assembling process; and the halogen gas is introduced into the quartz glass bulb from the second insertion opening in the introduction process after the evacuation process.

According to the above method, since the evacuation process may be carried out using the second insertion opening after the first insertion opening is sealed with one of the electrodes and then the second insertion opening is sealed with the other one of the electrodes, it is not necessary to form another opening specially designed for the evacuation process and no troublesome operation is required. Also, the halogen gas may be introduced to the quartz glass bulb by using the same insertion opening. The evacuation process may be performed by using any known device, such as a combination of a diffusion pump and a vacuum pump.

In yet another aspect of the invention, mercury is introduced into the quartz glass bulb from the second insertion opening in addition to the halogen gas in the introduction process.

In yet another aspect of the invention, an inert g introduced into the quartz glass bulb from the second insertion opening in addition to the halogen gas and mercury in the introduction process.

That is, after performing the evacuation process, mercury and the halogen gas and, preferably, the inert gas are introduced to the quartz glass bulb through the same insertion opening used for the evacuation process, and then the insertion opening is sealed with the electrode. The order of introduction of mercury, the halogen gas, and the inert gas may be interchanged. Also, two or more of these may be premixed and may be introduced to the quartz glass bulb at the same time.

The present invention also provides a method for manufacturing a high pressure discharge lamp including a quartz glass bulb having a sealing portion; a pair of electrodes, each electrode of the pair of electrodes being disposed so as to be opposite the other in the quartz glass bulb; and at least mercury, a halogen gas, and an inert gas contained and sealed in the quartz glass bulb, comprising the steps of: carrying out a first electrode assembling process in which one of the pair of electrodes is inserted into a first insertion opening formed in the quartz glass bulb and then the first insertion opening is airtightly sealed; carrying out an evacuation process in which oxygen present in the quartz glass bulb is evacuated from the second insertion opening after the first electrode assembling process; carrying out an introduction process in which mercury, the halogen gas, and the inert gas are introduced to the quartz glass bulb from a second insertion opening formed in the quartz glass bulb; and carrying out a second electrode assembling process in which the other one of the pair of electrodes is inserted into the second insertion opening and then the second insertion opening is airtightly sealed, wherein the quartz glass bulb is evacuated so that the partial pressure of oxygen (O) in the quartz glass bulb becomes about $2.5\times10^{-3}$ Pa or less in the evacuation process; and mercury is introduced so that the amount of mercury in the quartz glass bulb becomes about 0.15 mg/mm$^3$ or greater with respect to the volume of the quartz glass bulb, the halogen gas is introduced so that the partial pressure of the halogen gas in the quartz glass bulb falls into the range between about $1\times10^{-8}$ $\mu$mol/mm$^3$ and $1\times10^{-7}$ $\mu$mol/mm$^3$, and the inert gas is introduced so that the amount of the inert gas in the quartz glass becomes in the range between about $6\times10^3$ Pa and $6\times10^4$ Pa, in the introduction process.

The order of introduction of mercury, the halogen gas, and the inert gas may be interchanged. Also, two or more of these may be premixed and may be introduced to the quartz glass bulb at the same time.

In yet another aspect of the invention, the first and second insertion openings are airtightly sealed with the pair of electrodes via a conductive element so as to form the sealing portion in the first electrode assembling process and the second electrode assembling process, respectively.

In yet another aspect of the invention, the conductive element is preferably molybdenum foil.

According to the above method, high airtightness of the high pressure discharge lamp may be maintained even for a repeated heat cycle.

In yet another aspect of the invention, it is preferable that the method for manufacturing a high pressure discharge lamp further includes a step of: preheating the quartz glass bulb and members that form the electrodes toga temperature in the range between about 1,000° C. and 2,000° C. in vacuum. The members that form the electrodes include, other than the electrodes per se, the above-mentioned conductive element or molybdenum foil.

According to the above method, impurities which inhibit the halogen cycle, such as $O_2$, CO, $CO_2$, and $H_2O$, that are initially absorbed or contained in the quartz glass bulb and members that form the electrodes may be removed and, hence, it becomes possible to farther extend the lifetime of the high pressure discharge lamp according to an embodiment of the present invention.

In yet another aspect of the invention, the insertion openings and the electrodes are heated to a temperature in the range between about 1,000° C. and 2,000° C. in vacuum in the first electrode assembling process and the second electrode assembling process.

According to the above method, impurities which inhibit the halogen cycle, such as $O_2$, CO, $CO_2$, and $H_2O$, that are absorbed or contained in contact surfaces of the insertion openings and the electrodes may be removed prior to the sealing process and, hence, it becomes possible to further extend the lifetime of the high pressure discharge lamp according to an embodiment of the present invention.

BRIEF DESCRIPTION OF THE DRAWINGS

Some of the features and advantages of the invention have been described, and others will become apparent from the detailed description which follows and from the accompanying drawings, in which.

DETAILED DESCRIPTION OF THE INVENTION

It is an object of the present invention to provide a high pressure discharge lamp in which the above-mentioned problems have been solved.

It is also another object of the present invention to provide a high pressure discharge lamp having a high luminance, a high luminous efficacy, a long life and a high reliability.

It is yet another object of the present invention to provide a long-life high pressure discharge lamp which, even after being used for a long time, has a low degree of blackening or decrease in luminance and is capable of preventing leakage of a contained gas or a blowout of a bulb and a method for manufacturing such high pressure discharge lamp.

The invention summarized above and defined by the enumerated claims may be better understood by referring to the following detailed description, which should be read with reference to the accompanying drawings. This detailed description of a particular preferred embodiment, set out below to enable one to build and use one particular implementation of the invention, is not intended to limit the enumerated claims, but to serve as a particular example thereof.

Embodiment 1

Figure 1:
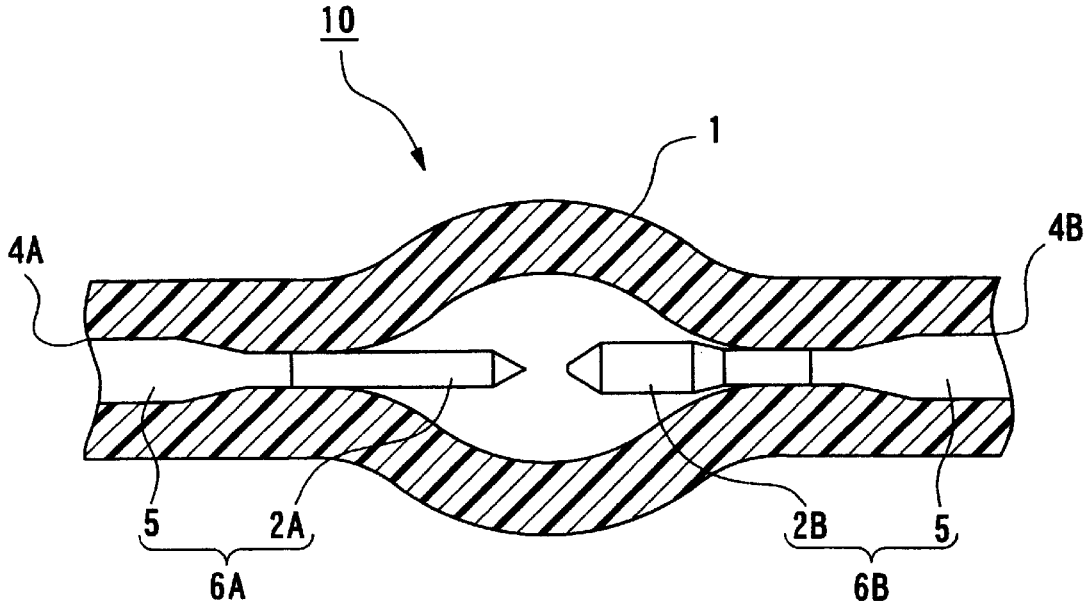
FIG. 1 is a diagram showing a schematic cross-sectional view of a high pressure discharge lamp according to an embodiment of the present invention.

FIG. 1 is a diagram showing a schematic cross-sectional view of a high pressure discharge lamp 10 according to an embodiment of the present invention. In FIG. 1, the high pressure discharge lamp 10 includes a quartz glass bulb 1, a pair of electrodes 2A and 2B made of tungsten, and molybdenum foils 5. The quartz glass bulb 1 has a round-shaped central portion and insertion openings 4A and 4B. The quartz glass bulb 1 may be formed by inserting the pair of electrodes 2A and 2B in the insertion openings 4A and 4B so as to be opposed to each other. The high pressure discharge lamp 10 shown in FIG. 1 is a DC high pressure discharge lamp and, hence, the shape of the electrode 2A is different from that of the electrode 2B. The shapes of the electrodes 2A and 2B, however can be the same for a case where the high pressure discharge lamp 10 is an AC high pressure discharge lamp, and in this embodiment the discharge lamp 10 can be a DC type or an AC type.

Each of these electrodes 2A and 2B is inserted from a respective insertion opening 4A or 4B located at an end of the bulb 1 and each of the insertion openings 4A and 4B is airtightly sealed with the respective electrode 2A or 2*b* via a sleeve-shaped molybdenum foil 5 which is a thermal cushioning material.

Inside, the airtightly sealed bulb 1 is evacuated so that the partial pressure of oxygen (O) becomes about $2.5\times10^{-3}$ Pa or less,—$2.0\times10^{-3}$ Pa in this embodiment—and mercury, a halogen gas and an inert gas are contain In this embodiment, the amount of mercury contained is 0.200 mg/mm$^3$. The amount of contained halogen gas—methylene bromide in this embodiment—is $5\times10^{-7}$ $\mu$mol/mm. The inert gas is argon gas in this embodiment and the pressure thereof is 50 kPa.

When the high pressure discharge lamp 10 is lit,an a trigger voltage is applied to the electrodes 2A and 2B, a glow discharge is induced between the electrodes 2A and 2B under the atmosphere of the above-mentioned inert gas and the contained mercury is vaporized to emit light of high luminance and excellent color rendering property due to a plasma discharge by the high pressure mercury vapor. It was observed that leakage of contained gases or a blowout of the bulb did not occur and blackening of the bulb was not generated even after the high pressure discharge lamp 10 was lit for a considerably long time, and the lamp 10 maintained the initial luminance.

Figure 2:
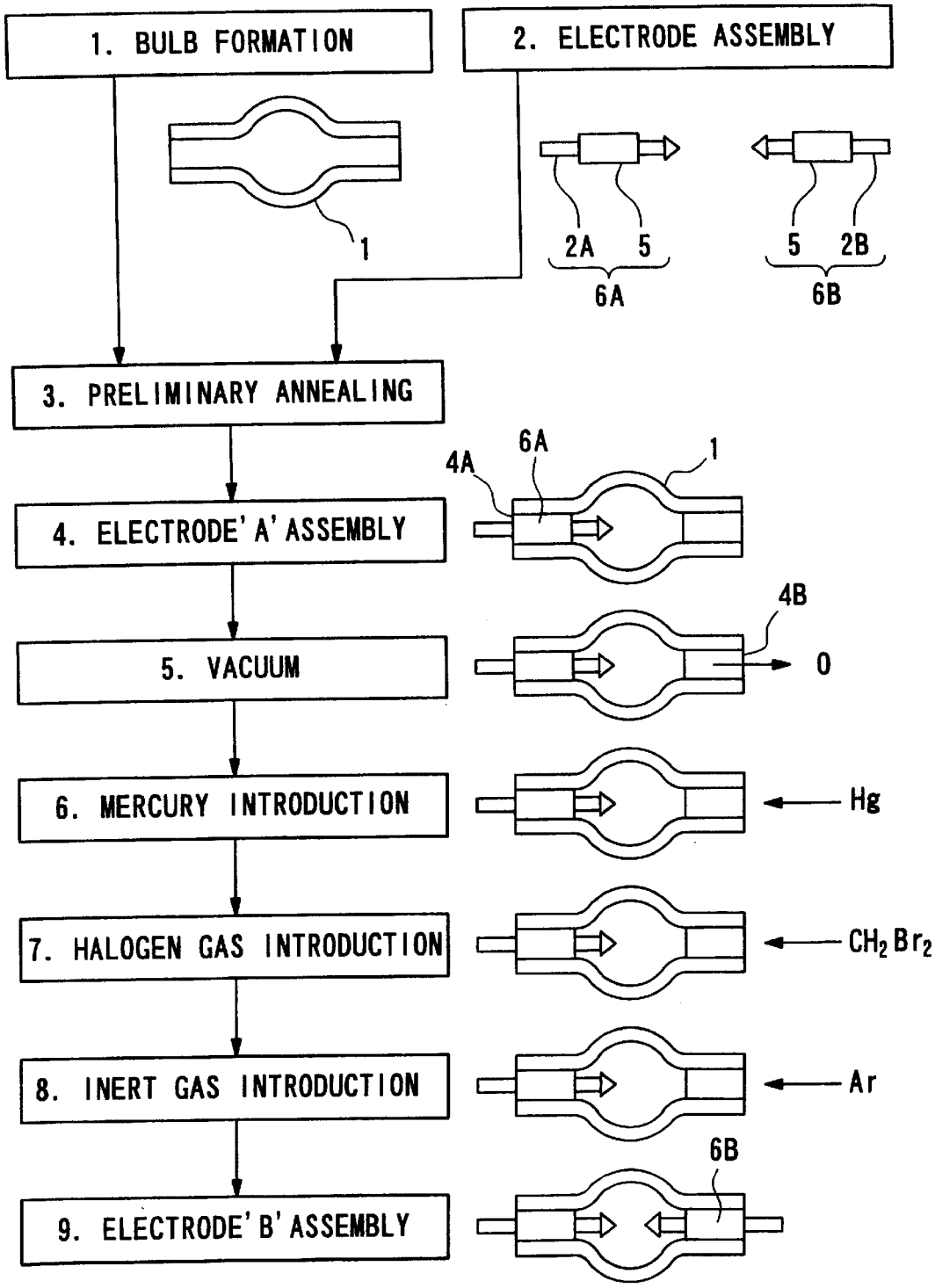
FIG. 2 is a diagram showing a process for manufacturing a high pressure discharge lamp according to an embodiment of the present invention.

The high pressure discharge lamp 10 was manufactured by using the processes indicated in FIG. 2. That is, Step 1 (bulb forming process): forming the bulb 1 by using a quartz glass pipe;

Step 2 (electrode assembling process): attaching a sleeve of molybdenum foil 5 to the corresponding electrode 2A or 2B made of tungsten to form electrode assemblies 6A and 6B;

Step 3 (preliminary annealing process): heating the bulb 1 and the electrode assemblies 6A and 6B at 800° C. under a vacuum condition for two hours to perform a preliminary annealing process;

Step 4 (electrode A assembling process): inserting the electrode assembly 6A in the insertion opening 4A of the bulb 1 and carrying out a sealing process of the insertion portion under a vacuum condition by heating the insertion portion at 1600° C. for 10 minutes;

Step 5 (vacuum process): evacuating the inside of the bulb 1 from the insertion opening 4B so that the partial pressure of oxygen (O) in the bulb 1 is decreased to about $2.0\times10^{-3}$ Pa;

Step 6 (mercury introduction process): introducing mercury inside the bulb 1 from the insertion opening 4B in an amount of about 0.200 mg/mm$^3$;

Step 7 (halogen gas introduction process): introducing methylene bromide ($CH^2Br^2$) inside the bulb 1 from the insertion opening 4B in an amount of about $5\times10^{-7}$ $\mu$mol/mm$^3$;

Step 8 (inert gas introduction process): introducing argon gas inside the bulb 1 from the insertion opening 4B at a pressure of about 50 kPa; and Step 9 (electrode B assembling process): inserting the electrode assembly 6B in the insertion opening 4B of the bulb 1 and carrying out a sealing process of the insertion portion under a vacuum condition by heating the portion at 1600° C. for 10 minutes.

Note that the order of Step 6 (i.e., mercury introduction process), Step 7 (i.e., halogen gas introduction process) and Step 8 (i.e., inert gas introduction process) may be interchanged. Also, various changes, for instance, premixing the halogen gas with the inert gas, or introducing the halogen gas and the inert gas inside the bulb 1 at the same time in order to shorten (or omit a part of) the process, may be made to an embodiment of the present invention.

Comparative Embodiment 1

A comparative high pressure discharge lamp was made conformable with a conventional high pressure discharge lamp in order to make comparison with the high pressure discharge lamp according to an embodiment of the present invention.

In the comparative high pressure discharge lamp, the same bulb and electrode assemblies used in the above-mentioned Embodiment 1 were employed.

In the manufacturing process, a vacuum process was performed so that the pressure inside the bulb was reduced to be $1\times10^{0}$ Pa which is a common internal pressure for a conventional high pressure discharge lamp. The partial pressure of oxygen (O) inside the bulb was $2\times10^{-1}$ Pa. The amount of mercury contained in the bulb was 0.200 mg/mm$^3$. The amount of contained halogen gas, i.e., methylene bromide in this embodiment, was $5\times10^{-6}$ $\mu$mol/mm$^3$. The pressure of inert gas, i.e., argon gas in this embodiment, was 50 kPa. The comparative high pressure discharge lamp in this Comparative Embodiment 1 was manufactured in accordance with the procedure shown in FIG. 2.

The lifetime of the high pressure discharge lamp in Embodiment and Comparative Embodiment 1, respectively, was evaluated. The evaluation was made under the condition of bulb wall loading of 1.5 W/mm$^2$, and the illuminance maintaining rate (%) of each lamp (the initial illuminance of the lamp was regarded as 100%) was measured over 2,000 hours.

Figure 3:
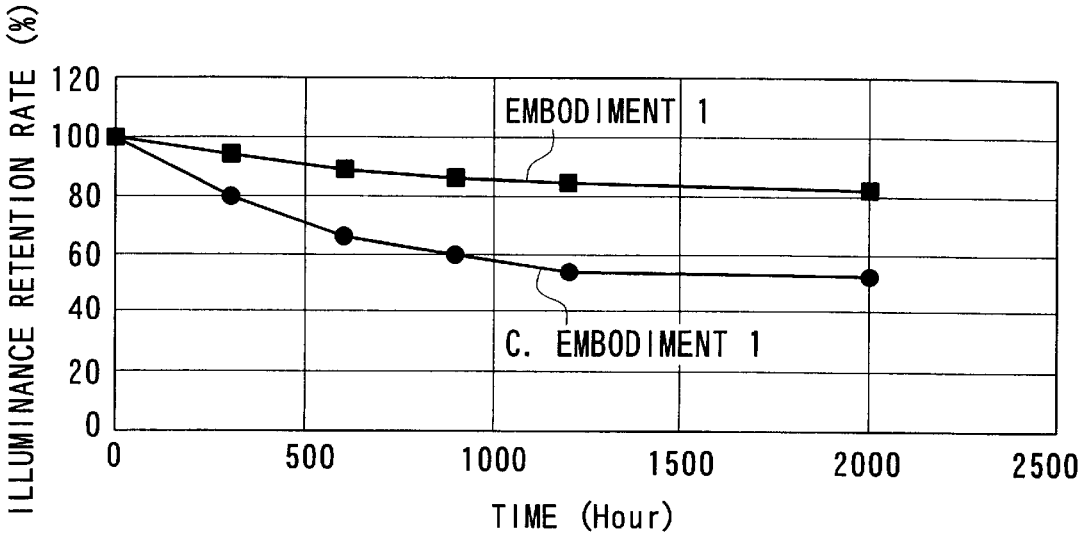
FIG. 3 is a graph showing an illuminance maintaining rate of a high pressure discharge lamp according to an embodiment of the present invention for illustrating the effect of the invention.
Figure 4:
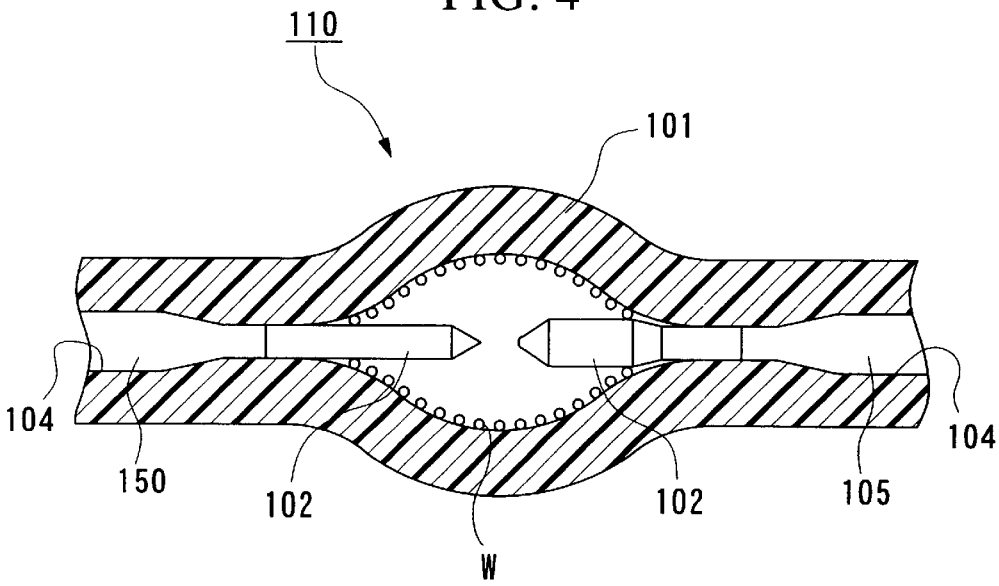
FIG. 4 is a schematic cross-sectional view of a conventional high pressure discharge lamp.

The results of the measurements are shown in FIG. 3. As it is obvious from the graph shown in FIG. 3, after 2,000 hours of lighting, more than 80% of the initial illuminance was maintained in the lamp of Embodiment 1 in which the partial pressure of oxygen (O) was $2.0\times10^{-3}$ Pa. Also, little generation of blackening was observed on inner surfaces of the bulb in Embodiment 1 after 2,000 hours of lighting, and it is expected that the lifetime of the lamp will be continuously maintained for a significantly long time.

On the other hand, the illuminance of the lamp in Comparative Embodiment 1, for which the vacuum process was performed to a conventional level, is decreased to less than 60% of its initial illuminance after 2,000 hours of lighting. Also, the generation of blackening on inner surfaces of the bulb was observed. It could be said that the lifetime of the lamp still remains but it is fair to say that the significantly large deterioration in the characteristics of the lamp in Comparative Embodiment 1 was caused.

Having thus described exemplary embodiments of the invention, it will be apparent that various alterations, modifications, and improvements will readily occur to those skilled in the art. Such alterations, modifications, and improvements, though not expressly described above, are nonetheless intended and implied to be within the spirit and scope of the invention. Accordingly, the foregoing discussion is intended to be illustrative only; the invention is limited and defined only by the following claims and equivalents thereto.

What is claimed is:

1. A method for manufacturing a high pressure discharge lamp including a quartz glass bulb having a sealing portion; a pair of electrodes, each electrode of said pair of electrodes being disposed so as to be opposite the other in said quartz glass bulb; and at least mercury and a halogen gas contained and sealed in said quartz glass bulb, comprising the steps of:

carrying out an evacuation process in which said quartz glass bulb is evacuated so that the partial pressure of oxygen (O) in said quartz glass bulb becomes about $2.5\times10^{-3}$ Pa or less; and carrying out an introduction process in which said halogen gas is introduced into said quartz glass bulb so that the partial pressure of said halogen gas in said quartz glass bulb falls in the range between about $1\times10^{-8}$ $\mu$mol/mm$^3$ and $1\times10^{-7}$ $\mu$mol/mm$^3$.

2. A method for manufacturing a high pressure discharge lamp according to claim 1, further comprising the steps of:

carrying out a first electrode assembling process in which one of said pair of electrodes is inserted into a first insertion opening formed in said quartz glass bulb and then said first insertion opening is airtightly sealed; and carrying out a second electrode assembling process in which the other one of said pair of electrodes is inserted into a second insertion opening formed in said quartz glass bulb and then said second insertion opening is airtightly sealed, wherein oxygen present in said quartz glass bulb is evacuated from said second insertion opening in said evacuation process after said first electrode assembling process and before said second electrode assembling process; and said halogen gas is introduced into said quartz glass bulb from said second insertion opening in said introduction process after said evacuation process.

3. A method for manufacturing a high pressure discharge lamp according to claim 2, wherein said mercury is introduced into said quartz glass bulb from said second insertion opening in addition to said halogen gas in said introduction process.

4. A method for manufacturing a high pressure discharge lamp according to claim 2, wherein an inert gas is introduced into said quartz glass bulb from said second insertion, opening in addition to said halogen gas and mercury in said introduction process.

5. A method for manufacturing a high pressure discharge lamp including a quartz glass bulb having a sealing portion; a pair of electrodes, each electrode of said pair of electrodes being disposed so as to be opposite the other in said quartz glass bulb; and at least mercury, a halogen gas, and an inert gas contained and sealed in said quartz glass bulb, comprising the steps of:

carrying out a first electrode assembling process in which one of said pair of electrodes is inserted into a first insertion opening formed in said quartz glass bulb and then said first insertion opening is airtightly sealed;

carrying out an evacuation process in which oxygen present in said quartz glass bulb is evacuated from said second insertion opening after said first electrode assembling process;

carrying out an introduction process in which said mercury, said halogen gas, and said inert gas are introduced to said quartz glass bulb from a second insertion opening formed in said quartz glass bulb; and carrying out a second electrode assembling process in which the other one of said pair of electrodes is inserted into said second insertion opening and then said second insertion opening is airtightly sealed, wherein said quartz glass bulb is evacuated so that the partial pressure of oxygen (O) in said quartz glass bulb becomes about $2.5\times10^{-3}$ Pa or less in said evacuation process; and said mercury is introduced so that the amount of said mercury in said quartz glass bulb becomes about 0.15 $mg/mm^3$ or greater with respect to the volume of said quartz glass bulb, said halogen gas is introduced so that the partial pressure of said halogen gas in said quartz glass bulb falls in the range between about $1\times10^{-8}$ $\mu mol/mm^3$ and $1\times10^{-7}$ $\mu mol/mm^3$, and said inert gas is introduced so that the amount of said inert gas in said quartz glass becomes in the range between about $6\times10^3$ Pa and $6\times10^4$ Pa, in said introduction process.

6. A method for manufacturing a high pressure discharge lamp according to claim 2, wherein said first and second insertion openings are airtightly sealed with said pair of electrodes via a conductive element so as to form said sealing portion in said first electrode assembling process and said second electrode assembling process, respectively.

7. A method for manufacturing a high pressure discharge lamp according to claim 6, wherein said conductive element is molybdenum foil.

8. A method for manufacturing a high pressure discharge lamp according to claim 5, wherein said first and second insertion openings are airtightly sealed with said pair of electrodes via a conductive element so as to form said sealing portion in said first electrode assembling process and said second electrode assembling process, respectively.

9. A method for manufacturing a high pressure discharge lamp according to claim 8, wherein said conductive element is molybdenum foil.

10. A method for manufacturing a high pressure discharge lamp according to claim 1, further comprising a step of:

preheating said quartz glass bulb and members that form said electrodes to a temperature in the range between about 1,000° C. and 2,000° C. in vacuum.

11. A method for manufacturing a high pressure discharge lamp according to claim 5, further comprising a step of:

preheating said quartz glass bulb and members that form said electrodes to a temperature in the range between about 1,000° C. and 2,000° C. in vacuum.

12. A method for manufacturing a high pressure discharge lamp according to claim 2, wherein said insertion openings and said electrodes are heated to a temperature in the range between about 1,000° C. and 2,000° C. in vacuum in said first electrode assembling process and said second electrode assembling process.

13. A method for manufacturing a high pressure discharge lamp according to claim 5, wherein said insertion openings and said electrodes are heated to a temperature in the range between about 1,000° C. and 2,000° C. in vacuum in said first electrode assembling process and said second electrode assembling process.

* * * * *